US005680655A

United States Patent [19]

Watanabe

[11] Patent Number: 5,680,655

[45] **Date of Patent: *Oct. 28, 1997**

[54] TROUSERS AND PROCESS OF PRODUCING SAME

[75] Inventor: Tatsuo Watanabe, Nagoya, Japan

[73] Assignee: Nikko Wool Textile Co., Ltd., Japan

[ * ] Notice: The term of this patent shall not extend beyond the expiration date of Pat. No. 5,361,417.

[21] Appl. No.: 489,617

[22] Filed: Jun. 12, 1995

Related U.S. Application Data

[63] Continuation-in-part of Ser. No. 165,469, Dec. 13, 1993, Pat. No. 5,361,417.

[30] Foreign Application Priority Data

Sep. 6, 1994 [JP] Japan ..... 6-212274

[51] Int. Cl.[6] ..... A41D 1/06; A41D 27/00

[52] U.S. Cl. ..... 2/227; 2/231; 2/233; 2/255

[58] Field of Search ..... 2/22, 23, 24, 2, 2/2.5, 267, 268, 227, 231, 79, 242, 69, 228, 232, 233, 255

[56] References Cited

U.S. PATENT DOCUMENTS

| | | | |
|---|---|---|---|
| 671,059 | 4/1901 | Sanders | 2/23 |
| 759,765 | 5/1904 | Stall | 2/23 |
| 2,411,328 | 11/1946 | MacNab | 2/24 |
| 4,354,280 | 10/1982 | Hayes | 2/24 X |
| 4,723,322 | 2/1988 | Shelby | 2/22 X |
| 4,831,666 | 5/1989 | Denman | 2/24 |
| 4,920,577 | 5/1990 | Scharf | 2/24 |
| 4,987,613 | 1/1991 | Loverdi et al. | 2/24 X |
| 5,267,354 | 12/1993 | Grilliot et al. | 2/227 |
| 5,361,417 | 11/1994 | Watanabe | 2/227 |

*Primary Examiner*—Jeanette E. Chapman
*Attorney, Agent, or Firm*—Parkhurst, Wendel & Burr, L.L.P.

[57] ABSTRACT

A pair of trousers including two leg coverings adapted to cover two legs of a wearer, respectively, each of the leg coverings including a front and a rear half, the front and/or rear halves having a crease line extending over a vertical length thereof, and two side portions extending along the crease line on both sides of the crease line, respectively; a first tape having a predetermined width, the first tape being adhered to respective inner surfaces of the side portions over a partial or entire length of the side portions along the crease line, so as to prevent respective parts of the side portions from opening in a direction in which the distance between the respective parts of the side portions increases; and one or more second tapes provided on, and adhered to, the first tape so as to prevent the first tape from stretching in a direction of width thereof because of tensile forces exerted thereto to open the side portions.

11 Claims, 5 Drawing Sheets

TROUSERS AND PROCESS OF PRODUCING SAME

This application is a continuation-in-part of U.S. patent application Ser. No. 08/165,469, filed Dec. 13, 1993, now U.S. Pat. No. 5,361,417.

BACKGROUND OF THE INVENTION

1. Field of the Invention

The present invention relates to a pair of trousers and a process of producing trousers and in particular to the art of creating, in trousers with durable creases, or durable crease lines on the top of creases, which are maintained sufficiently neat for a long period of use.

2. Related Art Statement

Generally, a pair of trousers has creases, or crease lines on the top of creases, which are set by, e.g., steaming in at least the front and rear halves of each of two leg coverings thereof. The crease lines enables a wearer to fold the trousers any time in the same fashion, thereby preventing the trousers from having undesirable wrinkles and/or becoming out of shape. In addition, when the trousers are worn by the wearer, the crease lines give a straight silhouette to the trousers, thereby improving the external appearance of the trousers.

While the trousers are worn by the wearer, tensile forces are exerted to the creases or crease lines in various directions because of physical motions of the wearer. Some of the tensile forces are exerted to the creases in directions in which to unfold or open the creases.

However, since the conventional creases or crease lines are created by just folding and/or steaming the trousers, they 'erase' little by little as the trousers are worn again and again, so that the trousers suffers from undesirable wrinkles and/or becomes out of shape and so that the external appearance of the trousers is lowered.

In the above background, there have been made various proposals to provide a pair of trousers having durable crease lines. A process of producing a pair of trousers, as one of those proposals, is illustrated in FIGS. 7(A), 7(B), and 7(C). More specifically, first, as shown in FIG. 7(A), an adhesive tape 334 is placed on an inner surface of a crease-line-forming portion 330 of a leg covering 312 of trousers 332. The crease-line-forming portion 330 is to be folded or creased to produce a crease line 314. Second, as shown in FIG. 7(B), the line-forming portion 330 and the adhesive tape 334 are folded such that the folded tape 334 is positioned inside the folded portion 330. Third, as shown in FIG. 7(C), steaming, for example, is applied from outside to the folded portion and tape 330, 334, so that the crease line 314 is formed or set on the top of the folded portion 330 and so that the folded tape 334 is adhered to the respective inner surfaces of side portions 316, 316 on both sides of the crease line 314.

When the crease-line-forming portion 330 and the adhesive tape 334 are folded and subsequently subjected to steaming, the position of the adhesive tape 334 relative to the creased portion 330, more precisely, the crease line 314 on the top of the creased portion 330 is displaced rearward, i.e., in the right-hand direction as seen in FIG. 7(C) by a certain distance from its original position shown in FIG. 7(A). At this displaced position, the adhesive tape 334 is adhered to the two side portions 316, 316 of the crease line 314 in such a manner that the tape 334 bridges the two side portions 316, 316. When the tensile forces resulting from the wearer of the trousers 332 are applied to the creased portion 330 in a direction in which to unfold or open the same 330, i.e., in the vertical direction as seen in FIG. 7(C), the two side portions 316, 316 of the crease line 314 are prevented, by the adhesive tape 334, from opening in a direction in which the distance between the two side portions 316, 316 increases.

However, in the above-mentioned case, the adhesive tape 334 itself is stretched in the direction of width thereof by the same tensile forces applied to the creased portion 330 to open the creased portion 330. The adhesive tape 334 may even peel off the side portions 316, 316 of the crease line 314.

Thus, the conventional trousers 332 are not free from the problem that the two side portions 316, 316 of the crease line 314 is opened widely because of the tensile forces exerted to the creased portion 330 from the wearer. For this reason, it is difficult to keep the creased portion 330 in shape or to keep the crease line 314 sufficiently neat for a long period of use.

SUMMARY OF THE INVENTION

It is therefore a first object of the present invention to provide a pair of trousers having a crease which is effectively supported so that two side portions of a crease line on the top of the crease are prevented from opening widely and so that the crease line enjoys improved durability and is kept sufficiently neat for a longer period of use.

It is a second object of the present invention to provide a process of producing a pair of trousers having a durable crease or crease line.

The first object has been achieved according to a first and a second aspect of the present invention. According to the first aspect of the present invention, there is provided a pair of trousers comprising: two leg coverings adapted to cover two legs of a wearer, respectively, each of the leg coverings including a front and a rear half, at least one of the front and rear halves having a crease line extending over a vertical length thereof, and two side portions extending along the crease line on both sides of the crease line, respectively; a first tape having a predetermined width, the first tape being adhered to respective inner surfaces of the side portions over at least a partial length of the side portions along the crease line, so as to prevent at least respective parts of the side portions from opening in a direction in which the distance between the respective parts of the side portions increases; and at least one second tape provided on, and adhered to, the first tape so as to prevent the first tape from stretching in a direction of width thereof because of tensile forces exerted thereto to open the side portions.

In the trousers in accordance with the first aspect of the invention, the first and second tapes are superposed on each other to provide, in rear of the crease line, an increased adhering or fixing area, so that the crease line is effectively fixed or set in the trousers. In addition, the first tape effectively prevents the side portions on both sides of the crease line from widely opening, and the second tape effectively prevents the first tape from stretching in the direction of width thereof because of the tensile forces exerted to open the side portions. Thus, the side portions on both sides of the crease line are effectively prevented from widely opening because of the tensile forces produced in the trousers when the trousers are being worn by a wearer. Accordingly, the crease line set in the present trousers can be kept sufficiently neat for a longer period of use as compared with a conventional trousers wherein a single tape is adhered to side portions on both sides of a crease line to prevent the side portions from opening.

According to a preferred feature of the first aspect of the invention, at least one of the first and second tapes comprises an adhesive cloth tape. In this case, the cloth tape is freely creaseable or foldable so that an excellent crease line is easily formed in the trousers. When the cloth tape contacts the skin of a leg of the wearer, the cloth tape minimizes the possibility of making the wearer uncomfortable.

According to another feature of the first aspect of the invention, at least one of the first and second tapes comprises a tape having a multiplicity of adhesive spots over an entire area of at least one of opposite surfaces thereof. In this case, the amount of use of the adhesive can easily and freely be controlled. Since no excessive amount of adhesive is used for adhering the first and second tapes to the side portions, no excessive adhesive bleeds out of the vicinity of the crease line. The external appearance of the trousers is not affected, and the wearer does not feel any discomfort.

According to yet another feature of the first aspect of the invention, at least one Of the first and second tapes comprises a tape including a heat-contractible cloth and a heat-sensitive adhesive provided on the heat-contractible cloth. In this case, heat pressing using, e.g., a stream iron is performed not only for setting the crease line but also for simultaneously adhering the first and/or second tapes to the respective inner surfaces of the side portions on both sides of the crease line. Accordingly, the process of producing the trousers having the excellent characteristics as described above is advantageously simplified, and the efficiency of production of the trousers or the efficiency of operation to produce the trousers is effectively improved. In addition, when the heat-contractible cloth of the tape contracts because of the heat applied thereto during the heat pressing, tensile stresses are produced in the tape. Those tensile stresses contribute to preventing the side portions on both sides of the crease line from opening widely, and thereby fixing or keeping the crease line.

According to a further feature of the first aspect of the invention, the first and second tapes partially overlap each other so that a part of one of the first and second tapes is not opposed to the other tape and is adhered to a corresponding one of the respective inner surfaces of the side portions. In this case, the trousers are free from a line or lines which may be perceived by an outside observer corresponding to the edge or edges of one or both of opposite end portions of the overlapping first and second tapes as viewed in the direction of width of the tapes. Thus, the present trousers are free from a problem that the external appearance thereof is lowered because of the adhering of the first and second tapes.

According to a second aspect of the present invention, there is provided a pair of trousers comprising: two leg coverings adapted to cover two legs of a wearer, respectively, each of the leg coverings including a front and a rear half, at least one of the front and rear halves having a crease line extending over a vertical length thereof, and two side portions extending along the crease line on both sides of the crease line, respectively; a first tape provided over respective inner surfaces of the side portions, the first tape extending over at least a partial length of the side portions along the crease line; a first adhesive layer provided between the side portions and the first tape to adhere the first tape to the side portions; a second tape provided over the first tape; and a second adhesive layer provided between the first and second tapes to adhere the second tape to the first tape.

The trousers in accordance with the second aspect of the invention enjoy the same advantages as described with respect to the trousers in accordance with the first aspect of the invention.

The second object has been achieved according to a third aspect of the present invention, which provides a process of producing a pair of trousers including two leg coverings adapted to cover two legs of a wearer, respectively, each of the leg coverings including a front and a rear half, at least one of the front and rear halves having a crease line extending over a vertical length thereof, and two side portions extending along the crease line on both sides of the crease line, respectively, the process comprising the steps of: (a) providing a first tape and a second tape on an inner surface of a portion of the at least one of the front and rear halves, over at least a part of the vertical length of the one of the front and rear halves, such that the first tape is interposed between the portion of the one of the front and rear halves and the second tape, (b) creasing the portion of the one of the front and rear halves and the first and second tapes, over the vertical length of the one of the front and rear halves, such that the creased first and second tapes are positioned inside the creased portion of the one of the front and rear halves, and (c) pressing the creased portion of the one of the front and rear halves and the creased first and second tapes, so that the creased portion of the one of the front and rear halves has the crease line extending over the vertical length, and the two side portions extending along the crease line on both sides of the crease line, respectively, and so that the creased first tape is adhered to the creased portion of the one of the front and rear halves and the creased second tape is adhered to the creased first tape.

In the process in accordance with the third aspect of the invention, the setting of the crease line and the adhering of the first and second tapes to prevent the side portions on both sides of the crease line from open widely are carried out simultaneously. Thus, the trousers which enjoy the excellent characteristics as described above can easily be produced in a reduced number of steps.

According to a preferred feature of the third aspect of the invention, the step of providing the first and second tapes comprises providing, as at least one of the first and second tapes, an adhesive cloth tape on the inner surface of the portion of the one of the front and rear halves.

According to another feature of the third aspect of the invention, the step of providing the first and second tapes comprises providing, as at least one of the first and second tapes, a tape having a multiplicity of adhesive spots over an entire area of at least one of opposite surfaces thereof, on the inner surface of the portion of the one of the front and rear halves.

According to yet another feature of the third aspect of the invention, the step of providing the first and second tapes comprises providing, as at least one of the first and second tapes, a tape including a heat-contractible cloth and a heat-sensitive adhesive provided on the heat-contractible cloth, on the inner surface of the portion of the one of the front and rear halves.

According to a further feature of the third aspect of the invention, the step of providing the first and second tapes comprises temporarily adhering the first tape to the inner surface of the portion of the one of the front and rear halves, and temporarily adhering the second tape to the first tape, such that the first tape does not peel off the one of the front and rear halves and such that the second tape does not peel off the first tape. In this case, during subsequent creasing and/or pressing operations of the present process, the first and second tapes are effectively prevented from peeling or coming off their predetermined positions, without having to take any additional operations. Thus, the trousers having the durable crease line or lines can be produced more easily and more efficiently.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
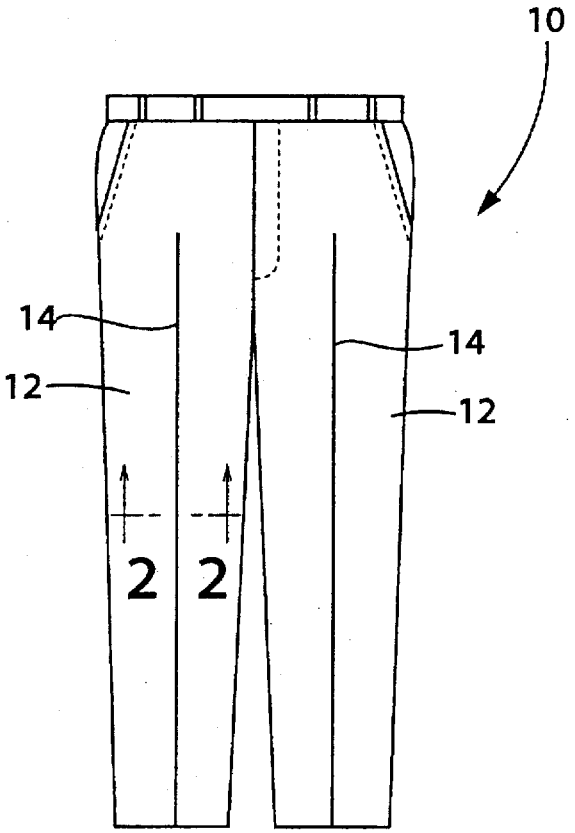
FIG. 1 is a front view of a pair of trousers embodying the present invention.

Referring first to FIG. 1, there is schematically illustrated a pair of trousers 10 made of wool fabric or yarn. The trousers 10 include two leg coverings 12, 12 for covering two legs of a wearer, respectively. Each of the two leg coverings 12, 12 includes a front half and a rear half (not shown). Each of the front and rear halves is creased at the middle thereof to have a continuous straight crease line 14 extending over an entire, vertical length thereof. Thus, the crease line 14 is set in each of the two halves of each of the two leg coverings 12, 12 of the trousers 10.

Figure 2:
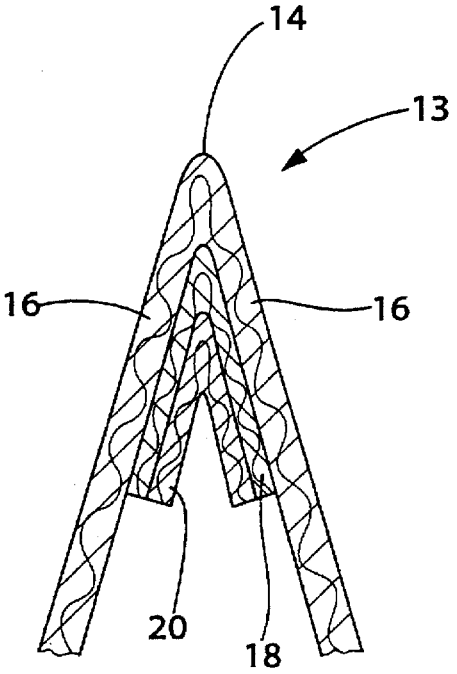
FIG. 2 is an enlarged cross-section view of a part of a leg covering of the trousers of FIG. 1, taken along lines 2—2 in FIG. 1.

FIG. 2 shows an enlarged transverse cross-section view of the vicinity of one of the crease lines 14 of the leg coverings 12, 12 of the trousers 10. As illustrated in the figure, each crease line 14 is defined by the top of a corresponding crease 13 having a generally inverted V-shape cross section and projecting frontward or rearward by a prescribed distance from the remaining of the front or rear half of a corresponding leg covering 12.

Each crease 13 has two side portions 16, 16 located on both sides of a corresponding crease line 14, respectively. A first adhesive tape 18 is adhered to the respective inner surfaces of the two side portions 16, 16 of each crease 13, over a partial or an entire length of the side portions 16, 16 along the crease line 14. A second adhesive tape 20 is adhered to the first adhesive tape 18. The adhesive tapes 18, 20 may extend completely to the bottom of each leg covering 12, or otherwise may extend intermediately to the knee of the wearer.

Figure 3:
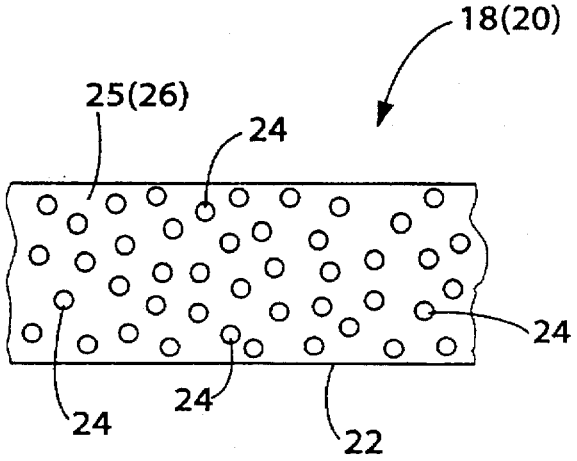
FIG. 3 is a plane view of a part of a first or a second adhesive tape which is adhered to an inner surface of the leg covering of FIG. 2.

As shown in FIG. 3, each adhesive tape 18, 20 includes a thin cloth tape 22 having a prescribed width. The cloth tape 22 is provided by a heat-contractible, plain weave textile formed of polyester fiber. Each adhesive tape 18, 20 has a multiplicity of heat-sensitive adhesive spots 24 provided on one of the opposite major surfaces of the cloth tape 22. This "one" surface will be referred to as the "adhesive surface"25 (for the first tape 28) or 26 (for the second tape 20). Thus, each adhesive tape 18, 20 is a heat-sensitive one-surface-adhesive tape. The multiplicity of heat-sensitive adhesive spots 24 of the first tape 18 provide a first adhesive layer between the side portions 16, 16 and the cloth tape 24 of the first tape 18, and the heat-sensitive adhesive spots 24 of the second tape 20 provide a second adhesive layer between the respective cloth tapes 24, 24 of the first and second tapes 18, 20.

The first adhesive tape 18 is thermally adhered to the two side portions 16, 16 of each crease 13 such that the first tape 18 bridges over a corresponding crease line 14. The second adhesive tape 20 is thermally adhered to the first tape 18 such that the second tape 20 is superposed on the first tape 18.

Next, there will be described a process of producing the trousers 10 constructed as described above.

Figure 4A:
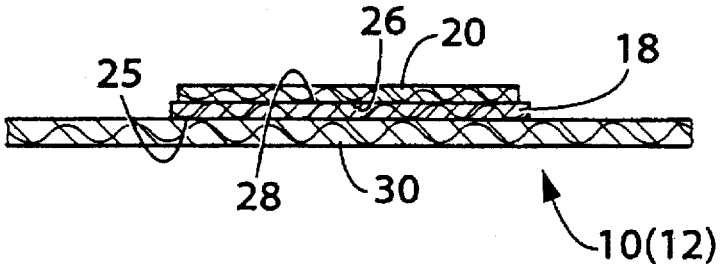
FIG. 4(A) is a view showing a first step of a first process employed to produce the trousers of FIG. 1, the first process embodying the present invention.

First, in a conventional manner, a selected material is cut and sewn to obtain a pair of trousers 10 before finishing. Subsequently, as shown in FIG. 4(A), a first and a second adhesive tape 18, 20 are positioned on the inner surface of a creasing portion 30 of each front or rear half of each leg covering 12 of the trousers 10. Each creasing portion 30 is an elongate portion to be creased to provide a corresponding crease line 14.

More specifically described, the first adhesive tape 18 is positioned on the inner surface of the elongate creasing portion 30 such that the adhesive surface 25 thereof is opposed to the creasing portion 30 and such that the first tape 18 extends along the length of the creasing portion 30. Subsequently, the second adhesive tape 20 is superposed on the first tape 18 such that the adhesive surface 26 thereof is opposed to a non-adhesive surface 28 of the first tape 18 and such that the second tape 20 extends along the length of the first tape 18. The first tape 18 is temporarily adhered to the inner surface of the creasing portion 30 in such a manner to prevent the first tape 18 from coming off the creasing portion 30, and the second tape 20 is temporarily adhered to the non-adhesive surface 28 of the first tape 18 in such a manner to prevent the second tape 20 from coming off the first tape 18. This temporary adhering is not a complete or full adhering of each tape 18, 20, but a partial or 'spot' adhering of the same. For example, each tape 18, 20 may be heated to adhesive stripes, lines, or 'spot' areas at regular intervals of distance.

Figure 4B:
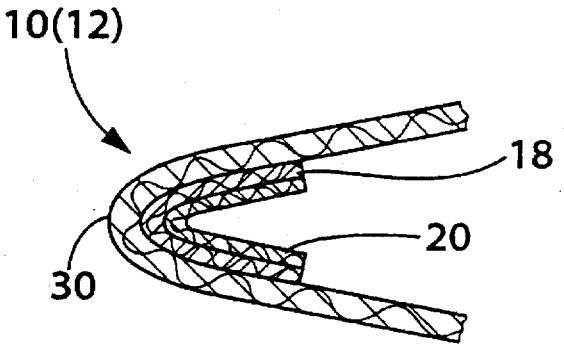
FIG. 4(B) is a view showing a second step of the first process.
Figure 4C:
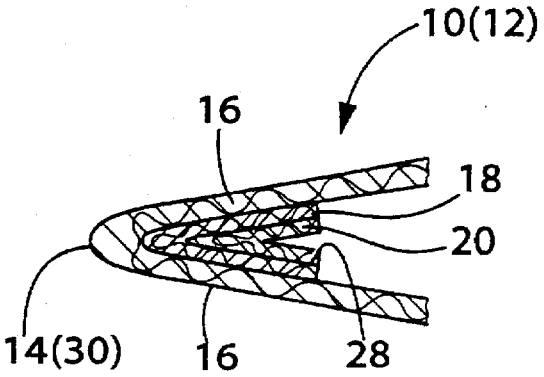
FIG. 4(C) is a view showing a third step of the first process.

Next, as shown in FIG. 4(B), the creasing portion 30 and the first and second adhesive tapes 18, 20 are creased along the length of the tapes 18, 20 such that the creased tapes 18, 20 are positioned inside the creased portion 30. Then, as shown in FIG. 4(C), the creased portion 30 and the two tapes 18, 20 are heated and pressed, on the outer surface of the portion 30, by, e.g., a stream iron. Thus, the creased portion 30 has a crease line 14 extending along the vertical length of each leg covering 12. Simultaneously, the first tape 18 is thermally adhered to the inner surface of the creased portion 30, and the second tape 20 is thermally adhered to the non-adhesive surface 28 of the first tape 18. That is, with the crease lines 14 being set in the trousers 10 as shown in FIG. 4(C) or 2, the first tape 18 is adhered and fixed to the side portions 16, 16 of the creased portion 30 (or crease 13), and the second tape 20 is adhered and fixed to the first tape 18. The adhesive 24 provided on each of the respective adhesive surfaces 25, 26 of the first and second tapes 18, 20 is thermally melted, expanded over the surface 25, 26, and impregnated into a corresponding cloth tape 22 as a tape basis. Thus, there is provided, in rear of each crease line 14, an increased adhering or fixing area having a thickness corresponding to the added thicknesses of the two superposed tapes 18, 20. When the two tapes 18, 20 contract due to heat applied thereto, the two tapes 18, 20 are subjected to tensile stresses produced therein, so that two side portions 16, 16 are tensed toward the crease line 14.

Thus, a pair of trousers 10 as an end product is produced which has the crease lines 14 set in the front and rear halves of the two leg coverings 12, 12 thereof and extending in the vertical direction of the leg coverings. In trousers 10, the first adhesive tape 18 is adhered to the respective inner surfaces of the side portions 16, 16 on both sides of each crease line 14, such that the first tape 18 bridges the two side portions 16, 16, and the second tape 20 is adhered to the first tape 18 such that the second tape 20 is superposed on the non-adhesive surface 28 of the first tape 18. The first tape 18 is accurately positioned relative to the creasing portion 30 (before being creased), and the second tape 20 is accurately positioned relative to the first tape 18.

When the trousers 10 are worn by a wearer, tensile forces are exerted, because of physical motions of the wearer, to the crease lines 14 or creases 13 in directions in which the distance of the two side portions 16, 16 increases. However, the side portions 16, 16 of the crease 13 are effectively prevented by the first tape 18 from opening widely due to the tensile forces. In addition, the first tape 18 is effectively prevented by the second tape 20 from stretching in the direction of width thereof because of the tensile forces exerted to open the side portions 16, 16. The opening-preventing and stretching-preventing effects of the first and second tapes 18, 20 are improved to higher degrees because of the tensile stresses resulting from the thermal contraction of the cloth tapes 22 thereof.

Thus, the pair of trousers 10 in accordance with the present invention enjoys not only the increased fixing area of the two superposed adhesive tapes 18, 20, but also the opening-preventing effect of the first tape 18 to prevent the side portions 16, 16 of each crease 13 from opening widely, and the stretching-preventing effect of the second tape 20 to prevent the first tape 18 from stretching in the direction of width thereof. Therefore, the trousers 10 are free from the problem that the creases 13 are opened widely or the crease lines 14 are 'erased'. The trousers 10 can be worn many times with the crease lines 14 or creases 13 being kept sufficiently neat.

Moreover, since each of the first and second tapes 18, 20 is provided by a cloth tape 22 having a prescribed width, each tape 18, 20 is easily folded or creased so that high-quality crease lines 14 are easily obtained.

Each adhesive tape 18, 20 includes a multiplicity of adhesive spots 24 provided on one surface 25, 26 of the cloth tape 22 thereof. Therefore, the amount of use of the adhesive 24 can easily be controlled. For example, use of an excessive amount of adhesive 24 is prevented, so that the excessive adhesive 24 is prevented from bleeding through the thickness of the side portions 16, 16 onto the outer surface of the leg covering 12, thereby deteriorating the external appearance of the vicinity of the side portions 16, 16 and/or making the wearer feel uncomfortable.

Since the adhesive 24 of each adhesive tape 18, 20 is heat-sensitive, the setting of each crease line 14 and the adhering of the first and second tapes 18, 20 can be carried out simultaneously, i.e., in a one step by heat pressing using, e.g., a steam iron. Thus, the process of producing the trousers 10 is simplified and the efficiency of production of the trousers 10 is much increased. Moreover, because of the tensile stresses resulting from the thermal contraction of the first and second tapes 18, 20, the side portions 16, 16 of each crease 13 or crease line 14 is effectively prevented from opening widely.

Since the setting of each crease line 14 and the adhering of the first and second tapes 18, 20 are carried out in one step in the process of producing the trousers 10, the durable crease line 14 internally supported by the tapes 18, 20 can easily be set in the trousers 10.

In the process of producing the trousers 10, the first tape 18 is temporarily adhered, in position, to the inner surface of the creasing portion 30 and the second tape 20 is temporarily adhered, in position, to the non-adhesive surface 28 of the first tape 18. Thus, the first tape 18 is effectively prevented from being displaced from the initial appropriate position relative to the creasing portion 30 and the second tape 20 is effectively prevented from being displaced from the initial appropriate position relative to the first tape 18. In addition, the first and second tapes 18, 20 are effectively prevented from peeling off the creasing portion 30 and the first tape 18, respectively. Thus, the subsequent creasing and pressing operations can be performed with high efficiency.

While the present invention has been described in its preferred embodiment, the present invention may otherwise be embodied.

For example, while in the illustrated embodiment the single second tape 20 is employed to be superposed on the first tape 18, it is possible to employ two or more second adhesive tapes 20 which are superposed on each other and all adhered to the first tape 18. In this case, one of the two second tapes 20 positioned on the side of the first tape 18 is effectively prevented by the other second tape from stretching in the direction of width thereof due to the tensile forces exerted to open the side portions 16, 16 of each crease 13. Thus, the opening of the crease 13 due to the tensile forces exerted thereto when the trousers 10 are worn by the wearer is even more effectively prevented.

Figure 5A:
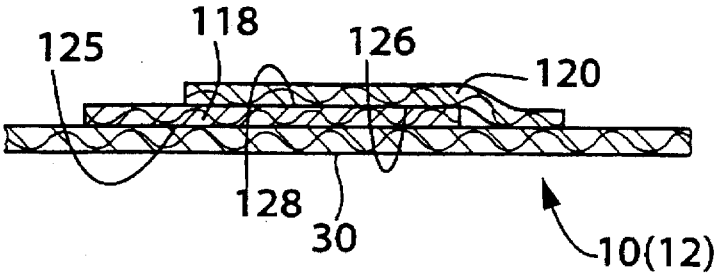
FIG. 5(A) is a view showing a first step of a second process employed to produce another pair of trousers embodying the present invention.
Figure 5B:
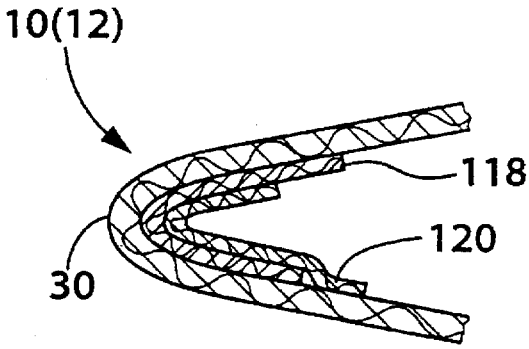
FIG. 5(B) is a view showing a second step of the second process.
Figure 5C:
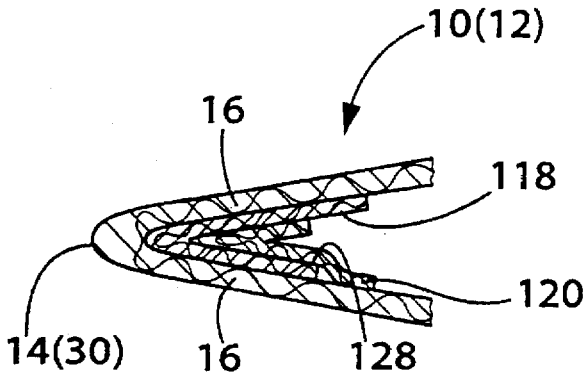
FIG. 5(C) is a view showing a third step of the second process.
Figure 6:
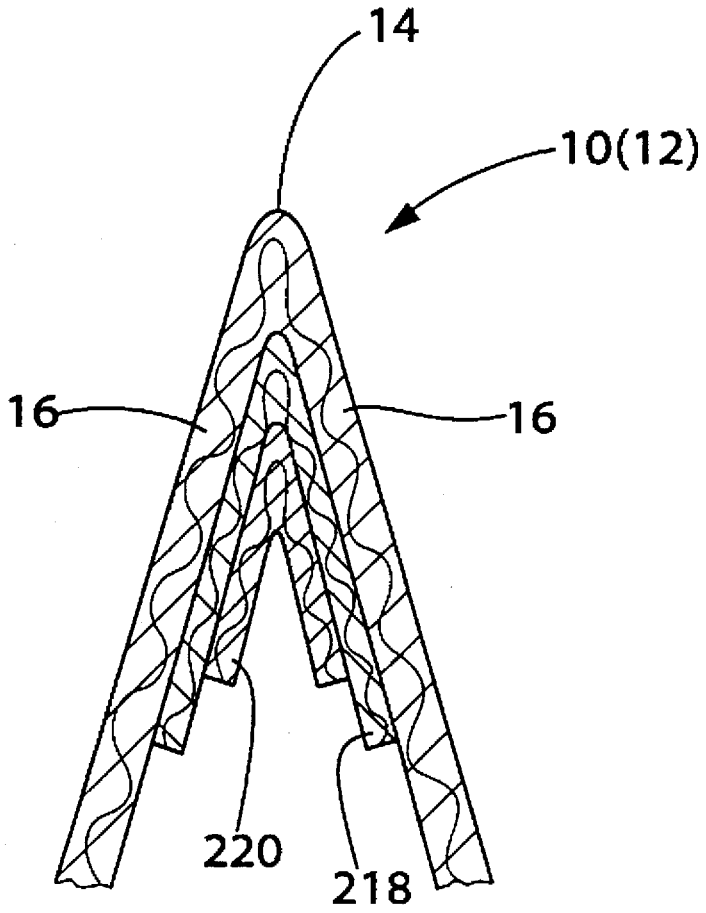
FIG. 6 is a view corresponding to FIG. 5(C), showing a leg covering of yet another pair of trousers embodying the present invention, wherein a first and a second adhesive tape thereof are superposed on each other in a manner different from that in which a first and a second adhesive tape of the trousers of FIG. 5(C) are superposed.
Figure 7A:
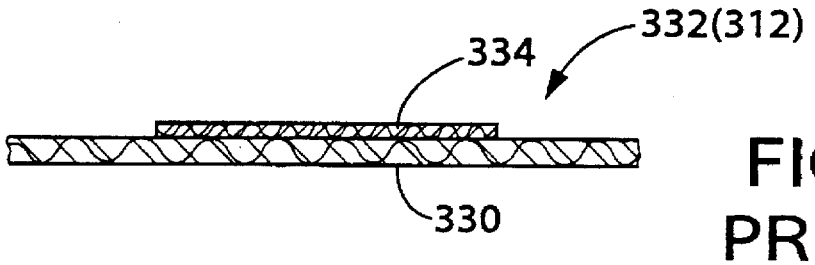
FIG. 7(A) PRIOR ART
FIG. 7(A) is a view corresponding to FIG. 4(A), showing a first step of a conventional process employed to produce a conventional pair of trousers.
Figure 7B:
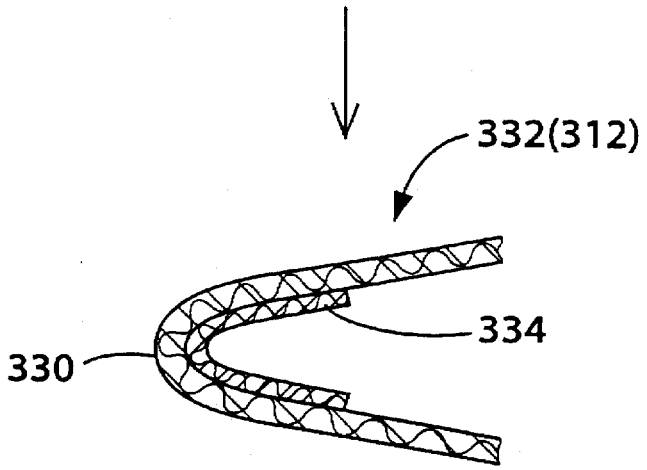
FIG. 7(B) PRIOR ART
FIG. 7(B) is a view corresponding to FIG. 4(B), showing a second step of the conventional process.
Figure 7C:
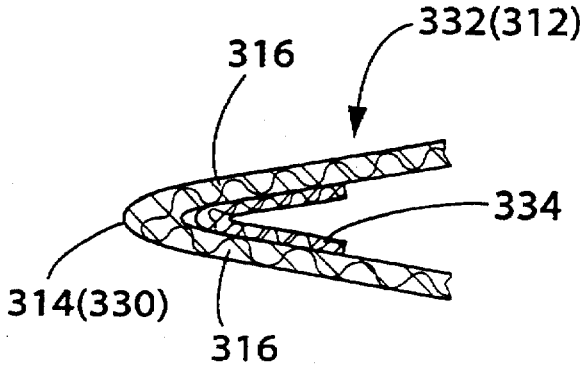
FIG. 7(C) PRIOR ART
FIG. 7(C) is a view corresponding to FIG. 4(C), showing a third step of the conventional process.

The manner of adhering or fixing of the first and second tapes 18, 18 is not limited to the illustrated one, but any other manner can be employed so long as the first tape 18 is adhered to the respective inner surfaces of the side portions 16, 16 such that the first tape 18 bridges over the crease line 14 and simultaneously the second tape 20 is adhered to the first tape 18 such at least a portion of the second tape 20 is superposed on the first tape 18. In any case, the side portions 16, 16 of the crease 13 are prevented from widely opening and the first tape 18 is prevented from stretching in the direction of width thereof due to the tensile forces exerted to open the side portions 16, 16. More specifically described, while in the illustrated embodiment the first and second tapes 18, 20 are adhered to each other in their entirety, it is possible to partially adhere the two tapes 18, 20 to each other at only appropriate portions or areas thereof. In addition, although the first and second tapes 18, 20 have the same width as shown in FIG. 2 and FIGS. 4(A) to 4(C) and adhered to each other in their entirety, it is possible to partially adhere a first adhesive tape 118 and a second adhesive tape 120 to each other over a prescribed partial width thereof as shown in FIGS. 5(A), 5(B), and 5(C). In addition, it is possible to employ a second adhesive tape 220 having a width shorter than a width of a first adhesive tape 218, as shown in FIG. 6. In the second embodiment shown in FIGS. 5(A) to 5(C), the first tape 118 has an end portion which has a prescribed width and is not covered by the second tape 120, and the second tape 120 has an opposite end portion which is directly adhered to a creasing portion 30. In the third embodiment shown in FIG. 6, the first tape 218 has two opposite end portions which are not covered by the second tape 220 and each of which has a prescribed width. In the second or third embodiment, the partially superposed first and second tapes 18, 20 have a pair of opposite end portions each of which has a prescribed width and consists of either one of the two tapes 18, 20. Thus, the respective outer surfaces of the side portions 16, 16 of each crease 13 are free from a line or lines which may be perceived corresponding to the edges of the opposite end portions of the superposed first and second tapes 18, 20. Thus, the external appearance of the trousers 10 as an end product is improved.

Although in the illustrated embodiment each adhesive tape 18, 20 is provided by a heat-sensitive one-surface-adhesive tape which has a number of heat-sensitive adhesive spots 24 over one surface of a cloth tape 24, it is possible to employ other types of adhesive tapes. For example, the cloth 22 used as a base member of each adhesive tape 18, 20 may be replaced by a material different from cloth, and the heat-sensitive adhesive 24 may be replaced by an adhesive which is not of a heat-sensitive type. The adhesive spots 24 provided over the adhesive surface 25, 26 of the first or second tape 18, 20 may be replaced by an adhesive layer which may be provided on one or both of the opposite major surfaces of the tape 18, 20. In particular, in the case where a first adhesive tape 18 having respective adhesive layers on both surfaces thereof is employed, a second tape can be employed which has no adhesive layer on either surface thereof and consists of a base member such as a cloth tape. Different adhesive tapes having different structures may be used as the first and second adhesive tapes 18, 20, respectively.

Moreover, while the illustrated embodiment relates to the trousers 10 made of wool fabric or yarn, the principle of the present invention is also applicable to other trousers made of other fabrics or yarns obtained from, e.g., synthetic fibers or cotton fibers.

It is to be understood that the present invention may be embodied with other changes, improvements, and modifications that may occur to those skilled in the art without departing from the spirit and scope of the invention defined in the appended claims.

What is claimed is:

1. A pair of trousers comprising:

two leg coverings adapted to cover two legs of a wearer, respectively, each of said leg coverings including a front half and a rear half, at least one of said front and rear halves having a crease line extending over a vertical length thereof, and two side portions extending along said crease line on both sides of the crease line, respectively;

a first tape having a predetermined width, said first tape being adhered to respective inner surfaces of said side portions over at least a partial length of the side portions along said crease line, so as to prevent at least respective parts of the side portions from opening in a direction in which the distance between said respective parts of the side portions increases; and at least one second tape provided on, and adhered to, said first tape to prevent the first tape from stretching in a direction of width thereof because of tensile forces exerted thereto to open said side portions.

2. The trousers as set forth in claim 1, wherein at least one of said first and second tapes comprises an adhesive cloth tape.

3. The trousers as set forth in claim 1, wherein at least one of said first and second tapes comprises a tape having a multiplicity of adhesive spots over an entire area of at least one of opposite surfaces thereof.

4. The trousers as set forth in claim 1, wherein at least one of said first and second tapes comprises a tape including a heat-contractible cloth and a heat-sensitive adhesive provided on said heat-contractible cloth.

5. The trousers as set forth in claim 1, wherein said first and second tapes partially overlap each other so that a part of one of the first and second tapes is not opposed to the other tape and is adhered to a corresponding one of the respective inner surfaces of said side portions.

6. A pair of trousers comprising:

two leg coverings adapted to cover two legs of a wearer, respectively, each of said leg coverings including a front half and a rear half, at least one of said front and rear halves having a crease line extending over a vertical length thereof, and two side portions extending along said crease line on both sides of the crease line, respectively;

a first tape provided over respective inner surfaces of said side portions, said first tape extending over at least a partial length of the side portions along said crease line;

a first adhesive layer provided between said side portions and said first tape to adhere the first tape to the side portions;

a second tape provided over said first tape; and a second adhesive layer provided between said first and second tapes to adhere the second tape to the first tape.

7. A process of producing a pair of trousers including two leg coverings adapted to cover two legs of a wearer, respectively, each of the leg coverings including a front half and a rear half, at least one of the front and rear halves having a crease line extending over a vertical length thereof, and two side portions extending along the crease line on both sides of the crease line, respectively, the process comprising the steps of:

providing a first tape and a second tape on an inner surface of a portion of said at least one of said front and rear halves, over at least a part of said vertical length of said one of the front and rear halves, such that said first tape is interposed between said portion of said one of the front and rear halves and said second tape, and creasing said portion of said one of said front and rear halves and said first and second tapes, over said vertical length of said one of the front and rear halves to form a crease line extending over said vertical length, such that the creased first and second tapes are positioned inside the creased portion of said one of the front and rear halves, and the creased first tape is adhered to the creased portion of said one of the front and rear halves and the creased second tape is adhered to the creased first tape.

8. The process as set forth in claim 7, wherein the step of providing said first and second tapes comprises providing, as at least one of said first and second tapes, an adhesive cloth tape on said inner surface of said portion of said one of said front and rear halves.

9. The process as set forth in claim 7, wherein the step of providing said first and second tapes comprises providing, as at least one of said first and second tapes, a tape having a multiplicity of adhesive spots over an entire area of at least one of opposite surfaces thereof, on said inner surface of said portion of said one of said front and rear halves.

10. The process as set forth in claim 7, wherein the step of providing said first and second tapes comprises providing, as at least one of said first and second tapes, a tape including a heat-contractible cloth and a heat-sensitive adhesive provided on said heat-contractible cloth, on said inner surface of said portion of said one of said front and rear halves.

11. The process as set forth in claim 7, wherein the step of providing said first and second tapes comprises temporarily adhering said first tape to said inner surface of said portion of said one of said front and rear halves, and temporarily adhering said second tape to the first tape, such that the first tape does not peel off said one of the front and rear halves and such that the second tape does not peel off the first tape.

* * * * *

UNITED STATES PATENT AND TRADEMARK OFFICE

CERTIFICATE OF CORRECTION

PATENT NO. : 5,680,655
DATED : October 28, 1997
INVENTOR(S) : Tatsuo Watanabe

It is certified that error appears in the above-identified patent and that said Letters Patent is hereby corrected as shown below:

Title page, [63], delete--

Continuation-in-part of Ser. No. 165,469, Dec. 13, 1993, Pat. No. 5,361,417."--

Column 1, lines 4-6, delete in their entirety.

Signed and Sealed this

Thirteenth Day of January, 1998

Bruce Lehman

*Attest:*

BRUCE LEHMAN

*Attesting Officer*

*Commissioner of Patents and Trademarks*